US005612005A

United States Patent [19]

Garvey

[11] Patent Number: 5,612,005

[45] Date of Patent: Mar. 18, 1997

[54] TWO CHAMBER REGENERATIVE THERMAL OXIDIZER

[75] Inventor: Richard Garvey, Northville, Mich.

[73] Assignee: Salem Engelhard, South Lyon, Mich.

[21] Appl. No.: 447,840

[22] Filed: May 23, 1995

Related U.S. Application Data

[63] Continuation of Ser. No. 206,970, Mar. 4, 1994, abandoned.

[51] Int. Cl.[6] ..... B01D 50/00

[52] U.S. Cl. ..... 422/171; 422/170; 422/172; 422/175; 422/178; 422/195

[58] Field of Search ..... 422/169, 170, 422/171, 172, 175, 178, 190, 191, 193, 195; 432/180, 181, 182

[56] References Cited

U.S. PATENT DOCUMENTS

| | | | |
|---|---|---|---|
| 5,000,422 | 3/1991 | Houston | 251/306 |
| 5,016,547 | 5/1991 | Thomason | 110/211 |
| 5,101,741 | 4/1992 | Gross et al. | 422/175 X |
| 5,129,332 | 7/1992 | Greco | 432/181 X |
| 5,163,829 | 11/1992 | Wildenberg | 422/175 X |
| 5,184,951 | 2/1993 | Nutcher et al. | 432/181 X |
| 5,229,077 | 7/1993 | Bell et al. | 422/168 |
| 5,259,757 | 11/1993 | Plejdrup et al. | 432/181 |
| 5,352,115 | 10/1994 | Klobucar | 432/181 |

*Primary Examiner*—Robert J. Warden
*Assistant Examiner*—Krisanne M. Thornton
*Attorney, Agent, or Firm*—Lyman R. Lyon, P.C.

[57] ABSTRACT

A two chamber regenerative thermal oxidizer comprises an oxidizing chamber and a pair of regenerator chambers. Inlet and outlet valves control fluid flow to and from said regenerator chambers. A transition duct communicates with a contaminated fluid feed duct upstream of the regenerator inlet valves and with the oxidizing chamber of said oxidizer. Electronic control means opens and closes valves, selectively, in a prearranged sequence whereby the inlet and outlet valves in an individual regenerator are never open at the same time, thereby precluding short circuiting of the regenerative chamber, yet all of the inlet and outlet valves to the regenerative chambers are never simultaneously closed thereby to maintain the pressure of fluid flow through said regenerator chambers relatively constant.

1 Claim, 3 Drawing Sheets

TWO CHAMBER REGENERATIVE THERMAL OXIDIZER

This is a continuation of application Ser. No. 08/206,970 filed on Mar. 4, 1994, now abandoned.

BACKGROUND OF THE INVENTION

This invention relates generally to the abatement of contaminant laden industrial process emissions and more specifically, to a ducting and valving system that directs and controls the flow of such emissions to and through a two chamber regenerative thermal oxidizer.

Industrial process emissions often contain combustible contaminants and/or odors that, if released to atmosphere, have the potential of polluting the environment. Thermal oxidizers increase the temperature of such process emissions to a temperature above the ignition temperature of the contaminants therein so as to oxidize the contaminants. Characteristically, flow control valves are used to direct the emissions to one or more regenerators for preheating prior to thermal oxidation.

One problem that materially effects the efficiency of such oxidizers is short circuiting of the thermal oxidizer by contaminated emissions incident to opening and closing of the valves required for control of fluid flow to and from the regenerators. Obviously, short circuiting of emissions between flow control valves in the partially open condition seriously compromises the efficiency of the oxidizer. Problems inherent in the design of two chamber regenerative oxidizers complicates the problem.

More specifically, as the chambers of known two chamber regenerative oxidizers switch from inflow to outflow, there is both a momentary change in system pressure due to simultaneous opening and closing of all valves and a momentary period where incoming contaminant laden emissions short circuit the common oxidation chamber. Pressure variations place excessive loads on the fluid moving equipment and are unacceptable in the processes being controlled via the regenerative oxidizers. Short circuiting of the oxidation chamber compromises the efficiency of the system.

SUMMARY OF THE INVENTION

The aforesaid problems associated with known two chamber regenerative oxidizers are solved by a novel transition circuit and valve operating sequence. The transition circuit enables cycling of a two chamber regenerative oxidizer without process pressure variations and without compromise of oxidation efficiency. The transition circuit contains an orifice plate and trim damper that are utilized to match the fluid flow resistance of the transition circuit to that of the oxidizer's regenerative chambers.

The flow control valves to the regenerative oxidizer are preferably power actuated electronically controlled valves of the type disclosed in U.S. Pat. No. 5,000,422 or U.S. Pat. No. 5,327,928 both of which are assigned to the assignee of the instant invention. Power actuating of the valves under the control of a computer offers precise timing and positive actuation.

The herein disclosed transition circuit and valve operating sequence preclude pollutant-laden air from short circuiting the oxidation chamber of the oxidizer yet system flow resistance is maintained constant by the transition circuit.

DETAILED DESCRIPTION OF THE PREFERRED EMBODIMENT

Figure 1:
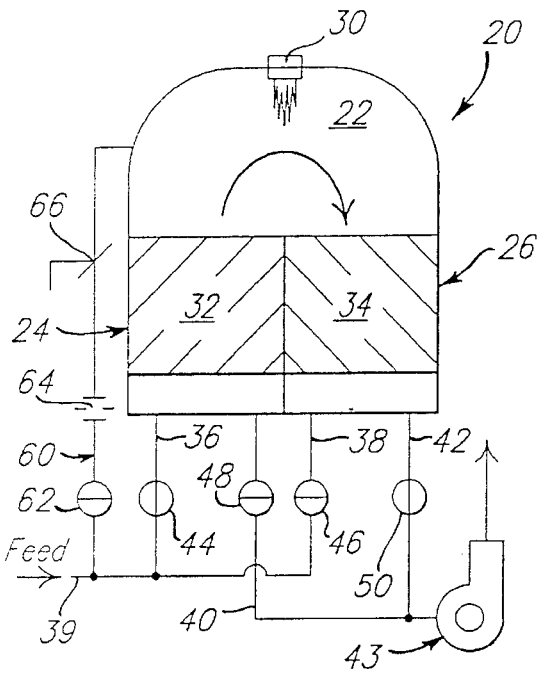
FIGS. 1–12 are similar diagrammatic representations of a two chamber regenerative thermal oxidizer showing the sequence of valve operation.

As seen in FIGS. 1–12, a two chamber regenerative oxidizer 20 comprises a common combustion chamber 22 overlying a pair of segregated regenerative chambers 24 and 26. The combustion chamber 22 is provided with a conventional burner 30 or other heat source. The regenerative chambers 24 and 26 are provided with conventional heat exchange or catalytic media, for example, ceramic saddles 32 and 34, respectively.

A contaminated emission duct 39 feeds the regenerative chambers 24 and 26 of the oxidizer 20 through a pair of inlet ducts 36 and 38, respectively. Outlet ducts 40 and 42 lead from the regenerative chambers 24 and 26, respectively to the low pressure side of an exhaust blower 43. The inlet ducts 36 and 38 are provided with flow control valves 44 and 46, respectively, and the outlet ducts 40 and 42 are provided with flow control valves 48 and 50, respectively.

In accordance with the present invention, a transition duct 60 extends from the contaminated emission feed duct 39 to the combustion chamber 22 of the oxidizer 20. The transition duct 60 is provided with a flow control valve 62. An orifice plate 64, and a trim damper 66, effect pressure control and balance of the flow of contaminated emissions to the oxidizer 20 at all operational modes thereof, as will be described.

In operation, and as seen in FIG. 1, contaminated emissions flow through feed duct 39, open valve 44, and duct 36 to regenerative chamber 24 wherein the emissions are preheated. The emissions then flow through the combustion chamber 22 thence outwardly through regenerative chamber 26, duct 42, and open valve 50 to the exhaust blower 43 for discharge to the atmosphere or other use. The transition circuit valve 62 is closed during the aforesaid first phase of operation.

Figure 2:
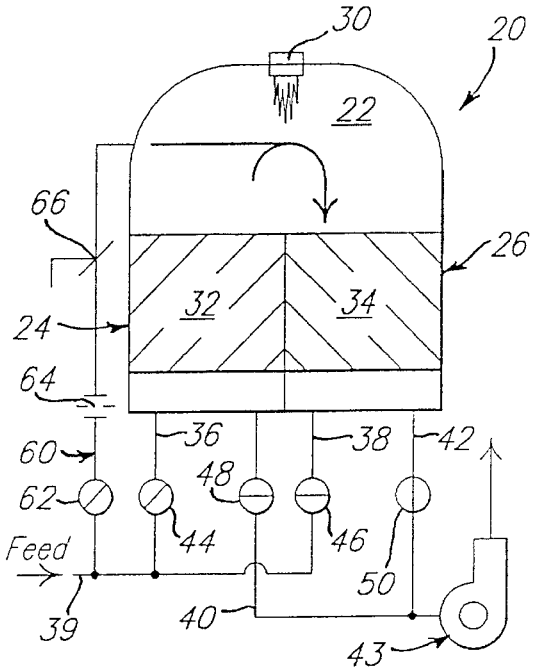

As seen in FIG. 2, inlet valve 44 begins to close and transition circuit valve 62 beings to open. Thus, emission inlet flow is through both the transition circuit 60 and regenerator inlet duct 36. Outlet flow continues through open valve 50 from regenerator 26.

Figure 3:
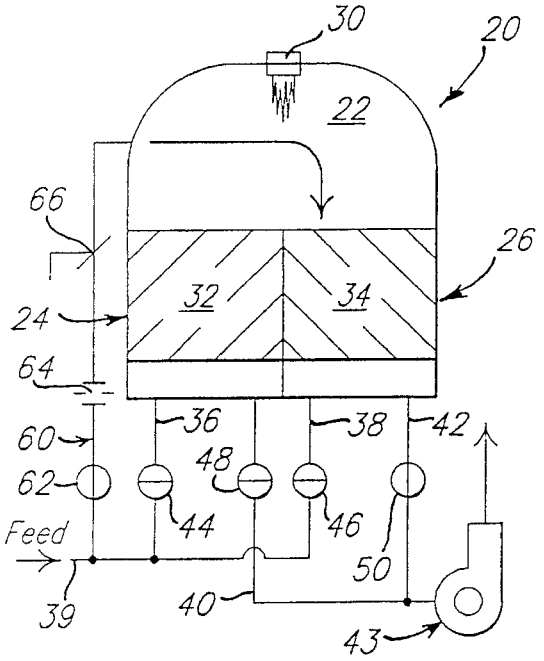

As seen in FIG. 3, regenerative chamber 24 is in an idle condition with both the inlet valve 44 and the outlet valve 48 closed. Transition circuit valve 62 is fully open resulting in 100% of inlet emissions flow through the transition circuit 60. Outlet flow remains through open outlet valve 50 from regenerator 26.

Figure 4:
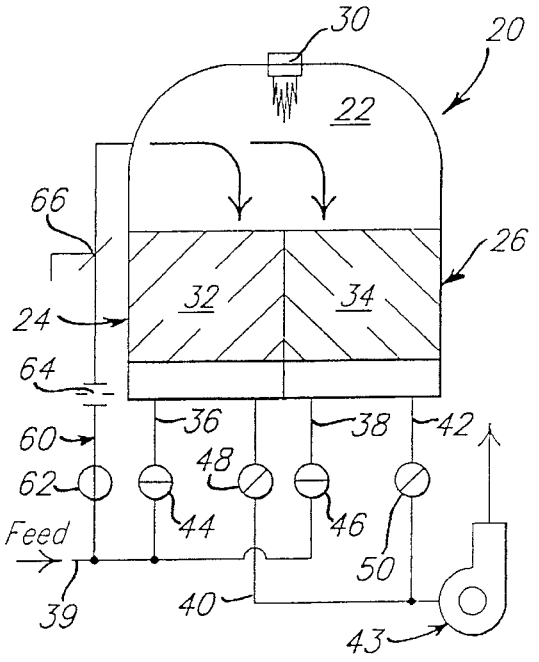

As seen in FIG. 4, the inlet valve 44 to the regenerator 24 remains closed and the outlet valve 48 begins to open. Simultaneously, outlet valve 50 from regenerator 26 begins to close. Inlet emission flow remains through open valve 62 and the transition circuit 60. Outlet flow is through partially open valves 48 and 50 from the regenerators 24 and 26, respectively.

Figure 5:
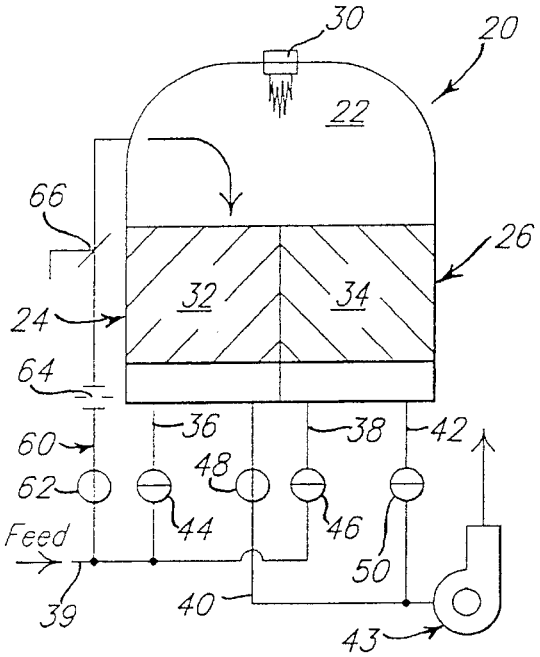

As seen in FIG. 5, regenerator 26 is in an idle condition with both inlet valve 46 and outlet valve 50 closed. Emissions inlet flow is solely through valve 62 and the transition circuit 60. Outlet flow is solely through fully open valve 48 from regenerator 24.

Figure 6:
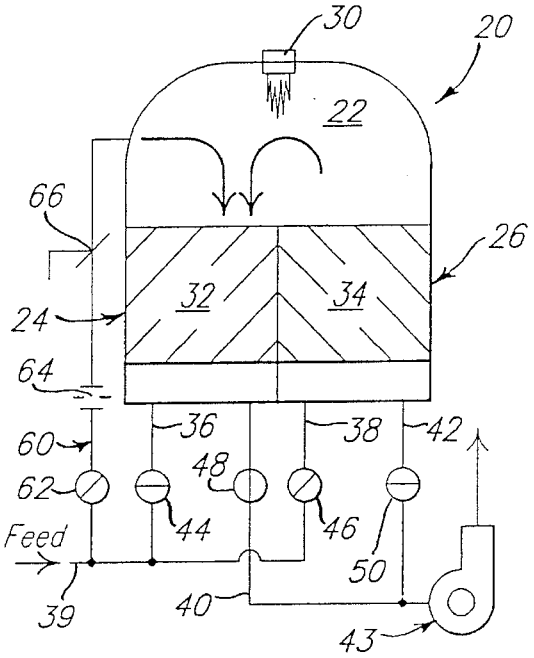

As seen in FIG. 6, outlet valve 50 from regenerator 26 remains closed, while inlet valve 46 begins to open and transition circuit 60 begins to close. Emission inlet flow is through both the transition circuit 60 to regenerator 24 and valve 46 to regenerator 26. Outlet flow from regenerator 24 is through open valve 48.

Figure 7:
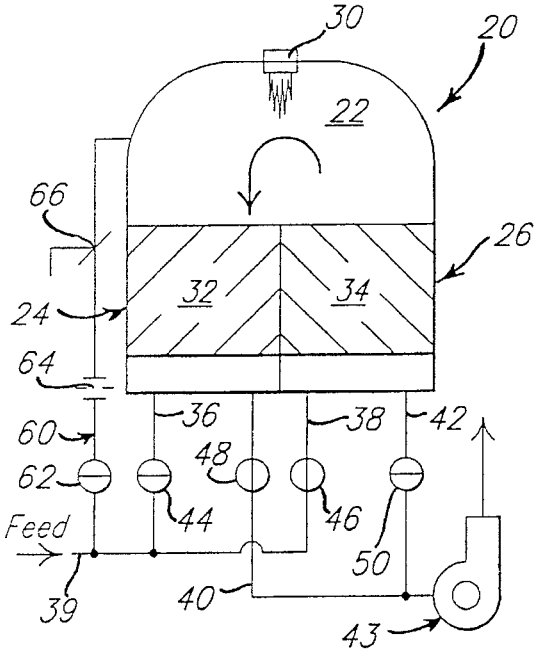

As seen in FIG. 7, transition circuit valve 62 and therefore transition circuit 60 is closed. Emission inlet flow is through open valve 46 to regenerator 26. Outlet flow is through valve 48 from regenerator 24.

Figure 8:
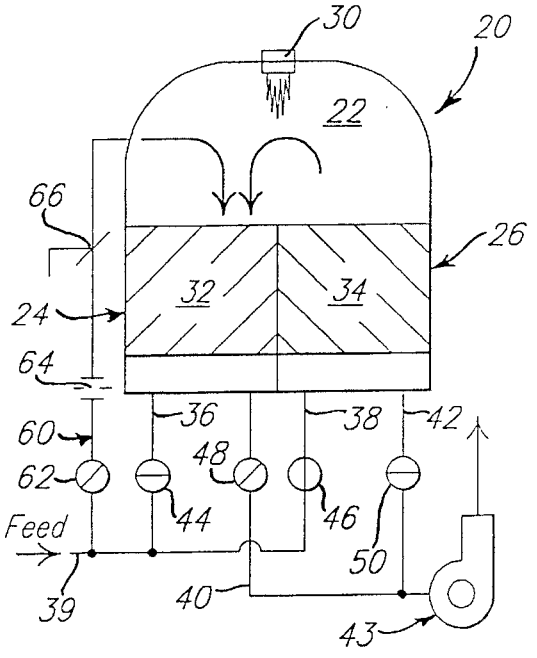

As seen in FIG. 8, inlet valve 46 to regenerator 26 begins to close and transition circuit valve 62 begins to open. Outlet flow is through valve 48 from regenerator 24. Emission inlet flow is shared between the transition circuit 60 and through valve 46 to regenerator 26.

Figure 9:
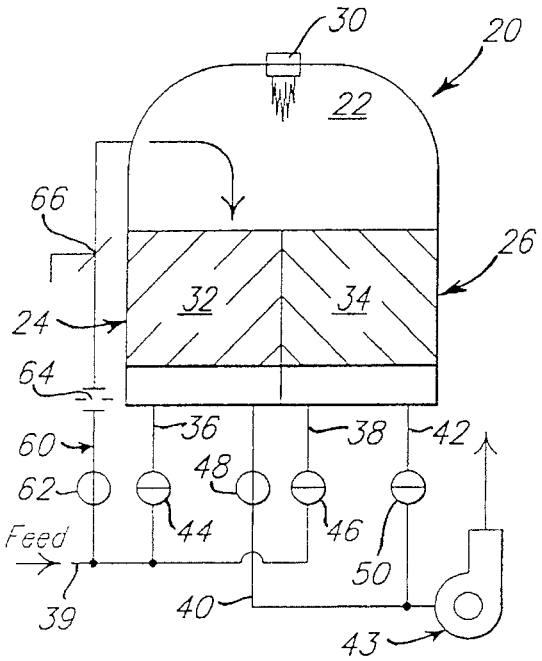

As seen in FIG. 9, regenerator 26 is in an idle position with both inlet valve 46 and outlet valve 50 closed. Inlet emission flow is solely through the transition circuit valve 62 and transition circuit 60. Outlet flow is through valve 48 from regenerator 24.

Figure 10:
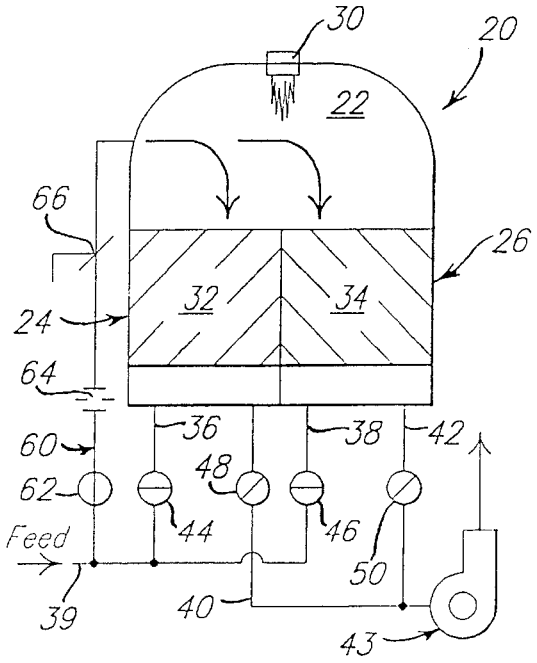

As seen in FIG. 10, the inlet valve 46 to regenerator 26 is closed and outlet valve 50 therefrom begins to open. Regenerator 24 outlet valve 48 begins to close. Emission inlet flow is solely through transition circuit valve 62 and the transition circuit 60. Outlet flow is shared between valves 48 and 50 from regenerators 24 and 26, respectively.

Figure 11:
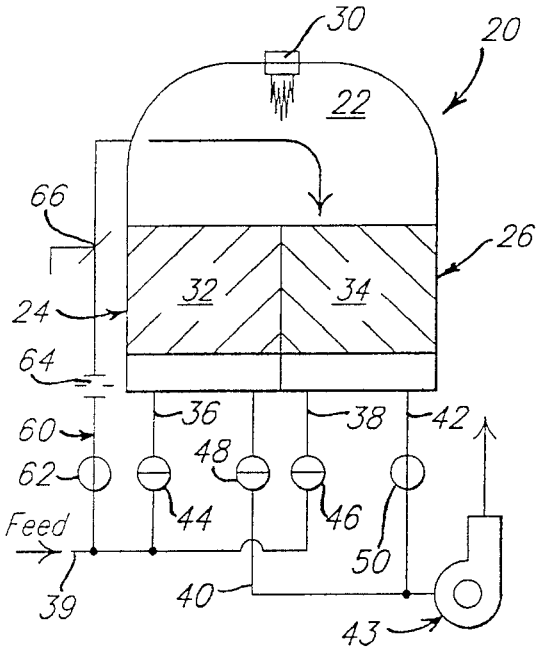

As seen in FIG. 11, regenerator 24 is in an idle condition with both the inlet valve 44 and the outlet valve 48 closed. Emission inlet flow is solely through transition circuit valve 62 and the transition circuit 60. Outlet flow is solely through valve 50 from regenerator 26.

Figure 12:
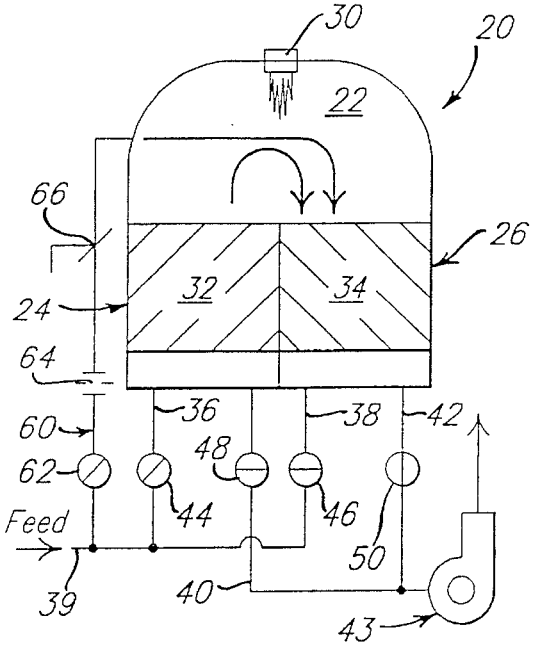

As seen in FIG. 12, the outlet valve 48 from the regenerator 24 is closed and the inlet valve 44 thereto begins to open. The transition circuit valve 62 in the transition circuit 60 begins to close conditioning the system 20 for operation as discussed with respect to FIG. 1.

From the foregoing it should be apparent that the transition circuit 60 permits an operating sequence that precludes contaminated emissions from short circuiting the oxidation chamber 22 of the thermal oxidizer 20. Moreover, static pressure variations are eliminated by that fact that at no time during the operating sequence are all of the inlet and/or outlet valves to the regenerative chambers 24 and 26 closed as well as by the orifice plate 64 and trim damper 66, in the transition circuit 60.

While the preferred embodiment of the invention has been disclosed, it should be appreciated that the invention is susceptible of modification without departing from the scope of the following claims.

I claim:

1. A two chamber regenerative thermal oxidizer comprising:

a contaminated fluid feed duct;

an oxidizing chamber;

a pair of regenerator chambers each having one side communicating with said oxidizing chamber;

a pair of regenerator chamber feed ducts communicating with an opposite side of said regenerator chambers, respectively, and directly with said contaminated fluid feed duct;

a pair of inlet valves disposed in said regenerator chamber feed ducts for controlling contaminated fluid flow to said regenerator chambers, respectively;

a pair of outlet ducts communicating with the opposite side of said regenerator chambers, respectively, and directly with a low pressure side of an exhaust blower;

a pair of outlet valves in said outlet ducts, respectively;

a transition duct communicating with said contaminated fluid feed duct upstream of said inlet valves and with said oxidizing chamber;

a valve in said transition duct for controlling flow therethrough;

an orifice plate in said transition duct for controlling the pressure of contaminated fluid flow therethrough;

a damper in said transition duct for balancing contaminated fluid pressure between said feed duct and the low pressure side of said exhaust blower; and control means for opening and closing said valves, selectively, in a prearranged sequence whereby at least one of the inlet valves in said regenerative chamber feed ducts leading to the opposite sides of said regenerator chambers, respectively, or the transition valve in the transition duct leading to said oxidizing chamber is open at all times and at least one of outlet valves is open at all times whereby the pressure of fluid flow through said regenerative thermal oxidizer is maintained relatively constant.

* * * * *